US011612826B2

(12) United States Patent
Elan

(10) Patent No.: US 11,612,826 B2
(45) Date of Patent: Mar. 28, 2023

(54) MULTI-FUNCTION CENTERED WHEEL RIDE-ON TOY

(71) Applicant: Miriam Emily Rhiannon Elan, Venice, CA (US)

(72) Inventor: Miriam Emily Rhiannon Elan, Venice, CA (US)

( * ) Notice: Subject to any disclaimer, the term of this patent is extended or adjusted under 35 U.S.C. 154(b) by 57 days.

(21) Appl. No.: 17/192,731

(22) Filed: Mar. 4, 2021

(65) Prior Publication Data

US 2021/0275933 A1 Sep. 9, 2021

Related U.S. Application Data

(60) Provisional application No. 62/985,244, filed on Mar. 4, 2020.

(51) Int. Cl.

| | |
|---|---|
| ***A63H 17/38*** | (2006.01) |
| ***A63H 17/26*** | (2006.01) |
| ***A47D 13/04*** | (2006.01) |

(52) U.S. Cl.

CPC ..... *A63H 17/38* (2013.01); *A47D 13/04* (2013.01); *A63H 17/262* (2013.01)

(58) Field of Classification Search

CPC ..... A63H 17/38; A63H 17/262; A63H 7/02; A63H 7/04; A63H 7/06; A47D 13/04; A47D 13/043; A47D 13/08; B62K 9/00; B62K 9/02; B62B 7/12; B62B 7/02

See application file for complete search history.

(56) References Cited

U.S. PATENT DOCUMENTS

| | | | | |
|---|---|---|---|---|
| 7,025,364 | B1 * | 4/2006 | Clarke | B62B 9/26 280/87.051 |
| 8,998,227 | B1 * | 4/2015 | Chen | A47D 13/102 280/87.051 |
| 2004/0094911 | A1 * | 5/2004 | Chang | A63G 19/18 280/1.188 |
| 2005/0146106 | A1 * | 7/2005 | Myers | A47D 13/107 280/87.051 |
| 2007/0052280 | A1 * | 3/2007 | Chen | B62K 9/02 301/5.301 |
| 2008/0179850 | A1 * | 7/2008 | Catelli | A47D 13/04 280/87.051 |
| 2011/0198819 | A1 * | 8/2011 | Jessie, Jr. | B62K 9/00 280/7.15 |

(Continued)

FOREIGN PATENT DOCUMENTS

| | | | | |
|---|---|---|---|---|
| CN | 105725593 A | * | 7/2016 | A47D 13/04 |
| CN | 110155149 A | * | 8/2019 | |

(Continued)

*Primary Examiner* — James A Shriver, II
*Assistant Examiner* — Ian Bryce Shelton

(57) ABSTRACT

A ride-on toy includes a main body having a lower wall and a centered wheel. The centered wheel is rotatably mounted in the main body with a portion of the wheel protruding from the main body through an opening in the lower wall, such that when the ride-on toy is disposed on a flat surface, it can be rocked back and forth relative to an axis defined by the centered wheel. A seat is arranged over the wheel and between two handles of different lengths. Stabilizers are connected to the lower wall at opposite sides of the opening. The centered wheel may be hollow and contain one or more developmental toys.

18 Claims, 11 Drawing Sheets

(56) References Cited

U.S. PATENT DOCUMENTS

| | | | | |
|---|---|---|---|---|
| 2014/0159331 | A1* | 6/2014 | Wu | A47D 13/04<br>280/87.051 |
| 2016/0332654 | A1* | 11/2016 | Langham | B62B 7/048 |
| 2017/0259878 | A1* | 9/2017 | Rogers | B62K 21/12 |
| 2021/0339155 | A1* | 11/2021 | Reitano | A47L 11/22 |

FOREIGN PATENT DOCUMENTS

| | | | | |
|---|---|---|---|---|
| DE | 202008014418 | U1 * | 5/2010 | A47D 13/04 |
| EP | 3705372 | A1 * | 9/2020 | |
| GB | 2520588 | A * | 5/2015 | B62B 7/02 |
| KR | 20100008044 | U * | 8/2010 | |
| WO | WO-8500531 | A * | 2/1985 | A63G 19/00 |
| WO | WO-2020024007 | A1 * | 2/2020 | A47L 11/22 |

* cited by examiner

200

300

300

320

400

400

MULTI-FUNCTION CENTERED WHEEL RIDE-ON TOY

CROSS-REFERENCE TO RELATED APPLICATIONS

The present application claims the benefit of U.S. provisional Patent Application No. 62/985,244, filed on Mar. 4, 2020, the disclosure of which is hereby incorporated by reference herein in its entirety.

BACKGROUND OF THE INVENTION

Field of the Invention

The present application generally relates to children's ride-on toys and, more particularly, to a centered wheel ride-on toy having multiple functions.

Description of the Prior Art

Ride-on toys are popular toys for young children and typically feature a body that is supported by two or more wheels. The body also typically has a saddle or seat portion and a handle, hand grips, handlebars, steering wheel or the like which the child grips while sitting in or on the toy. A child sitting on the toy propels the toy by pushing off the ground with his or her feet. Push-walkers are another popular toy that is pushed or pulled along the ground.

As safety issue with ride-on toys and push-walkers is the lack of speed control, which can be a particular problem with toddlers. Moreover, given that ride-on toys and push-walkers are generally used at different stages in a child's development, the cost and clutter of having multiple toys in the home is a problem faced by many parents. This problem is only compounded by the many other developmental toys parents provide to their children.

A need therefore exists for a ride-on toys that allow children to safely explore riding, pushing and climbing at their own pace and stimulating all their senses, while at the same time taking into to account cost and space requirements.

SUMMARY OF THE INVENTION

Embodiments of the present invention address the aforementioned problems by providing a ride-on toy comprising a main body, a centered wheel, a seat, and a first handle. The main body comprises a lower wall having a first opening. The wheel rotatably mounted in the main body, wherein a portion of the wheel protrudes from the main body through the first opening. The seat is connected to the main body, and the first handle extending away from the main body. The components of the ride-on toy are arranged such that when it is disposed on a flat surface, it can be rocked back and forth relative to an axis defined by the centered wheel.

In embodiments of the application, the ride-on toy further comprises a first stabilizer connected to the lower wall at a first side of the first opening. The first stabilizer is arranged such that when the ride-on toy is disposed on a flat surface in a first position, the surface and the first stabilizer are separated by a first distance, and when the ride-on toy is disposed on the surface in a second position, the first stabilizer contacts the surface.

In further embodiments of the application, the ride-on toy further comprises a second stabilizer connected to the lower wall at a second side of the first opening opposite to the first side. The second stabilizer is arranged such that when the ride-on toy is disposed on the surface in the first position, the surface and the second stabilizer are separated by the first distance, and when the ride-on toy is disposed on the surface in the second position, the second stabilizer is separated from the surface by a second distance greater than the first distance. In this embodiment, when the ride-on toy is disposed on the surface in a third position, the second stabilizer contacts the surface, and the first stabilizer is separated from the surface by a third distance greater than the first distance.

In embodiments of the application, the main body, the first stabilizer, and the second stabilizer are made of plastic, and the plastic of the first and second stabilizers is softer than that of the main body.

In embodiments of the application, the first handle comprises two arms and a first bar connecting the two arms at distal ends thereof. In further embodiments, the ride-on toy comprises second handle is longer than the first handle, wherein the seat is disposed between the first and second handles. The second handle may also comprise two arms and a second bar connecting the two arms at distal ends thereof.

In preferred embodiments of the application, the main body comprises a cavity and a wheel support is disposed in the cavity, wherein the wheel is rotatably disposed on the wheel support. In some embodiments, the wheel comprises a hollow first cylinder, the wheel support comprises a second cylinder, and the second cylinder is sleeved by the first cylinder. In this embodiment, one of the first cylinder and the second cylinder may comprises a plurality of rows of sockets, and the other of the first cylinder and the second cylinder may comprises a plurality of inner tracks corresponding to the plurality of rows, wherein a plurality of balls are received in the sockets and rotatable such that the wheel is rotatable relative to the wheel support. In other embodiments, one of the first cylinder and the second cylinder comprises a plurality of sockets, and a plurality of cylindrical rollers are received in the sockets and rotatable such that the wheel is rotatable relative to the wheel support.

It is contemplated that in some embodiments the second cylinder is hollow and the main body comprises a second opening corresponding to a first side of the wheel. A first accessory toy may be disposed in the second opening, wherein the first toy accessory comprises openings communicating with and/or is partially received in an interior space of the second cylinder.

In other embodiments of the application, the wheel support comprises a first axle support, a second axle support, and an axle connecting the first and second axle supports, wherein the wheel is rotatably disposed on the axle. In preferred embodiments, the first axle support is hollow and the main body comprises a second opening corresponding respectively a first side of the wheel. A first accessory toy may be disposed in the second opening, the first accessory toy communicating with and/or partially received in an interior space of the first or second axle supports.

In still other preferred embodiments, the second axle support is hollow and the main body comprises a third opening corresponding respectively to a second side of the wheel opposite to the first side of the wheel. A second accessory toy may be disposed in the third opening, the second accessory toy communicating with and/or partially received in an interior space of the first or second axle supports.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE EMBODIMENTS

In order to make the above objects, features and advantages of the embodiments of the present invention easier to understand, a detailed description is given in the following embodiments with reference to the accompanying drawings.

Figure 1:
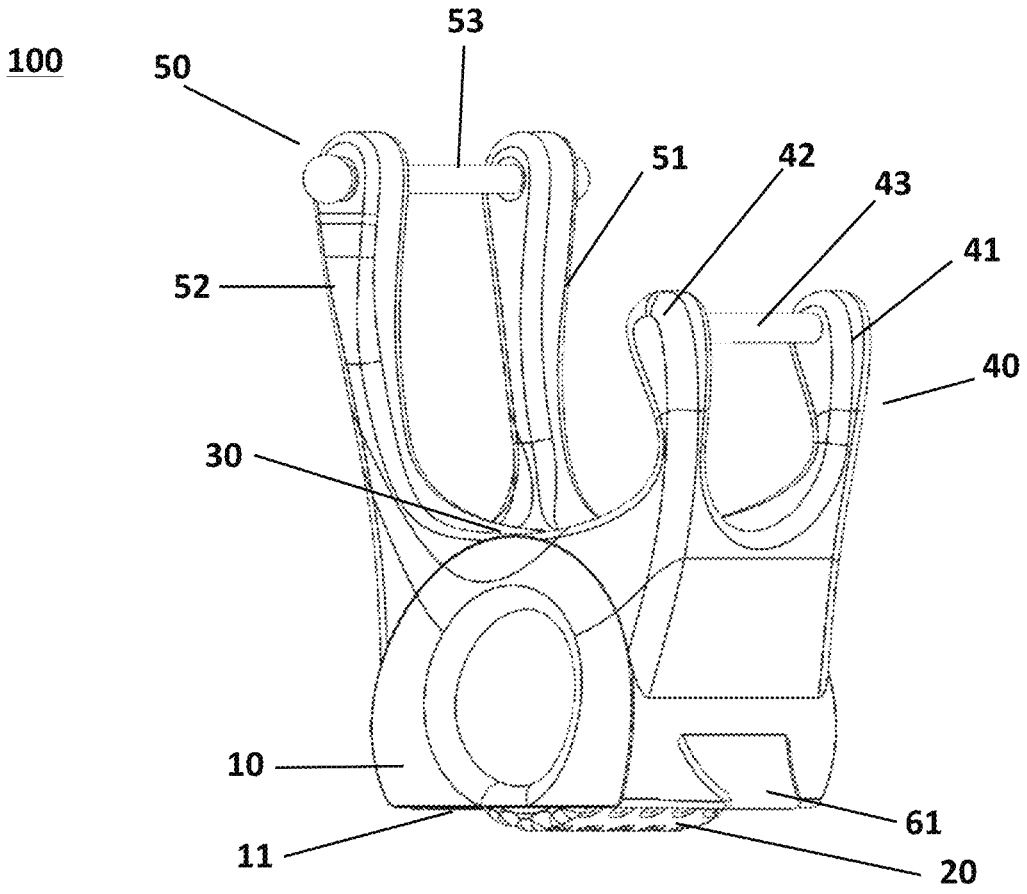
FIG. 1 is a front perspective view of a ride-on toy of a first embodiment of the application.
Figure 2:
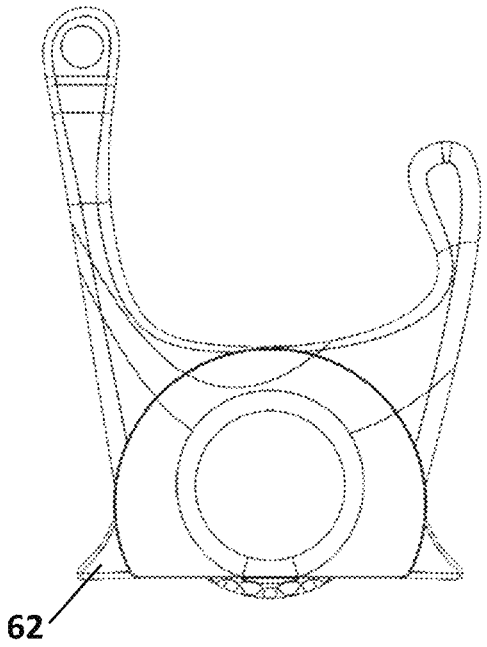
FIG. 2 is a side view of the first embodiment of the application.
Figure 3:
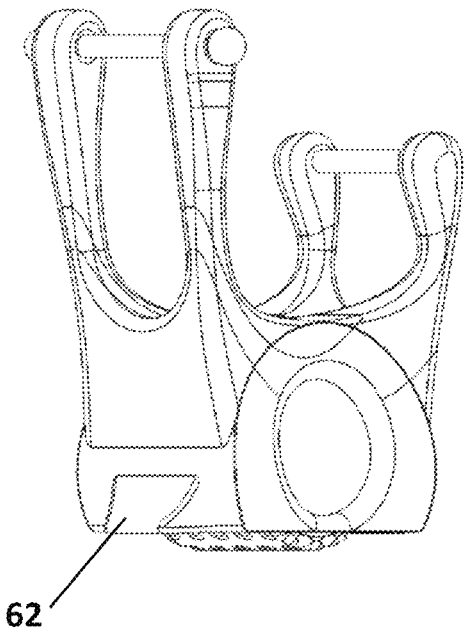
FIG. 3 is a rear perspective view of a first embodiment of the application.

FIGS. 1-3 illustrate a first embodiment of a ride-on toy 100 of the application. Ride-on toy 100 comprises a main body 10, a wheel 20, a seat 30, a front handle 40, a rear handle 50, a front stabilizer 61 and a rear stabilizer 62. As shown in the figures, wheel 20 is mounted in and protrudes from a lower wall 11 of the main body 10. More particularly, wheel 20 is centered, allowing the ride-on toy to rock back and forth on an axis defined by the wheel in a see-saw manner. As shown in FIG. 2, in embodiments of the application, wheel 20 is centered relative to the main body 10 and seat 30. As illustrated, and in preferred embodiments that will be described in detail in this application, wheel 20 is a single wheel of the ride-on toy 100. However, it is contemplated that in other embodiments, two or more wheels may be provided on a single centered axle. In embodiments of the application, the main body 10, wheel 20, seat 30, handles 40 and 50 and stabilizers 61 and 62 are made of plastic. However, in other embodiments, other materials such as wood, fiberglass, and metal may be used for elements of the ride-on toy of the application.

Figure 4:
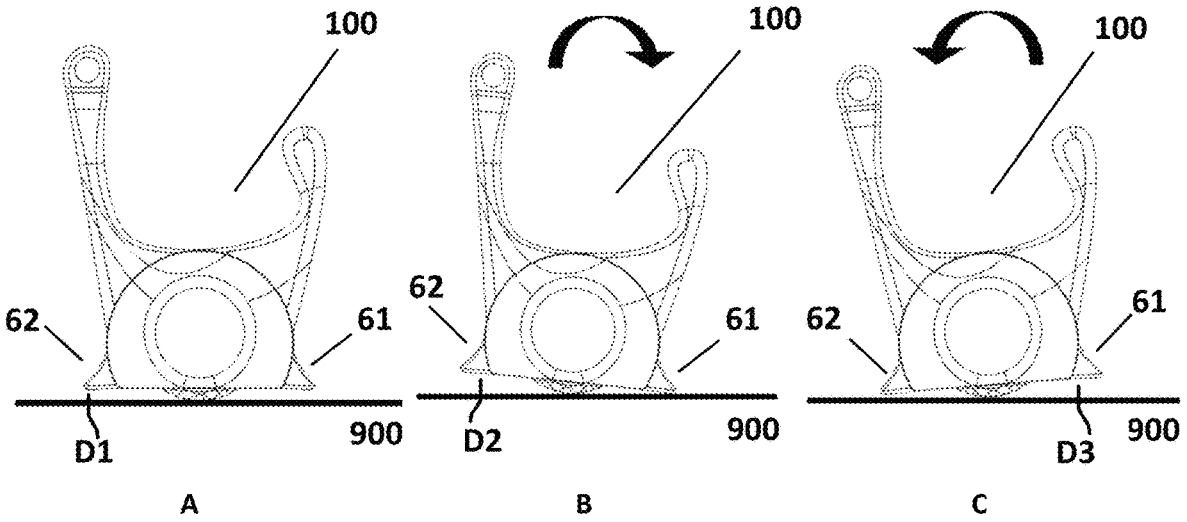
FIG. 4 is a side view of a ride-on toy of the application in three different positions.

As best seen in FIG. 2, stabilizers 61 and 62 are provided at opposite sides of lower wall 11 and protrude outwardly along a plane of the lower wall 11. As shown in FIG. 4, in embodiments of the application, the arrangement of the centered wheel 20 protruding from the lower wall 11 of the main body 10 and stabilizers 61 and 62 allows the ride-on toy 100 to rock back and forth when positioned of a flat surface 900 such as a floor or the ground. In the neutral position A, the ride-on toy 100 is balanced, with stabilizers 61 and 62 each separated from the flat surface 900 by a first distance D1. In position B, the ride-on toy 100 is tilted forward, such that front stabilizer 61 is in contact with flat surface 900, while back stabilizer 62 is lifted further from the flat surface 900 such that it is separated from the flat surface 900 by second distance D2 greater than D1. In position C, the ride-on toy 100 is tilted backward, such that front stabilizer 62 is in contact with flat surface 900, while front stabilizer 61 is lifted further from the flat surface 900 such that it is separated from the flat surface 900 by third distance D3 greater than D1. In preferred embodiments, distances D2 and D3 are equal. In preferred embodiments, distance D1 is between 1-2 cm, while the distances D2 and D3 are between 2-4 cm. In embodiments of the application, front and rear stabilizers 61 and 62 are made from plastic softer than main body 10 and are threaded into, interlocked with, adhered to, or otherwise connected to main body 10. In other embodiments, main body 10 and stabilizers 61 add 62 may be integrally formed.

Figures 5A, 5B:
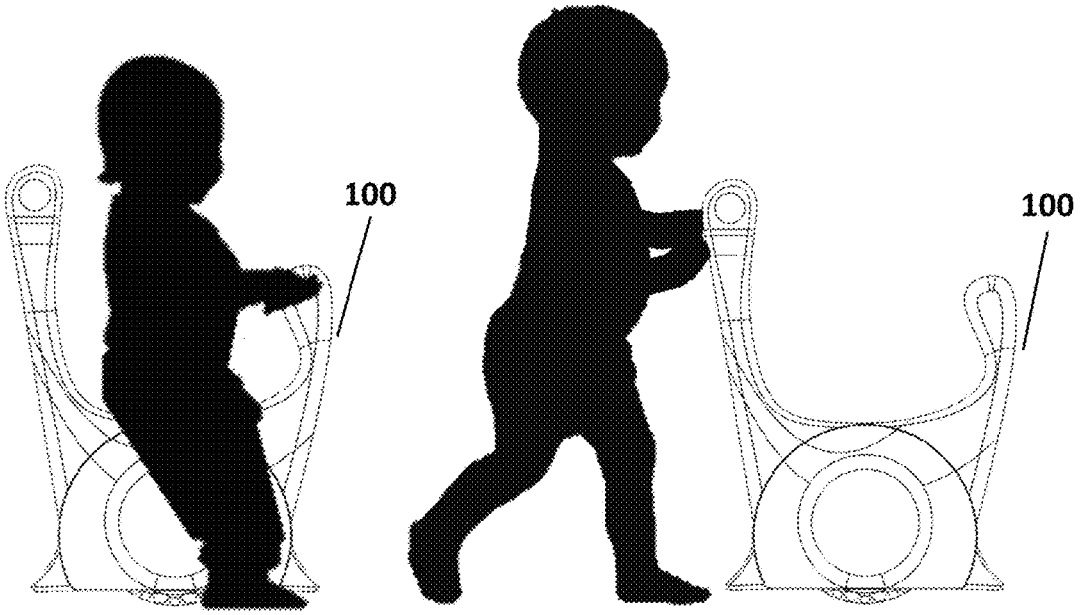
FIGS. 5A and 5B are side views of a ride-on toy of the application in two different usage modes.

As illustrated in FIGS. 5A and 5B, ride-on toy 100 can be used in two modes, the ride mode shown in FIG. 5A and the push-walker mode shown in FIG. 5B. Distances D1, D2, and D3 define the rocking motion of ride-on toy 100 when it used in a ride mode as shown in FIG. 5A, and furthermore act to limit the speed of ride-on toy 100 when it is in either ride mode or push-walker mode.

In ride mode, ride-on toy 100 acts as a rocker when a child sits in seat 20 and moves their body back and forth. To move the ride-on toy 100 forward or back along the floor challenges a toddler to push himself to smoothly so as to keep the ride-on toy 100 in the neutral position A, requiring effort in to push with legs while keeping the ride-on toy stable so it cruises smoothly. This technique of riding is easily learned by a child's fast adapting bodies and minds, but creates enough of a challenge to stimulate their mind and body's development, working all their senses.

In push-walker mode, it is difficult for children to keep the ride-on toy 100 in the neutral position A when pushing it above a certain speed, and depending on the pressure of their leaning, a forward rocking motion will provide a controlled push or stop when front stabilizer 61 touches the ground in position B, preventing them from falling. Similarly, if a child loses balance and tilts the walker backwards to position C, rear stabilizer 62 creates a stop until the child finds their balance. As arranged in embodiments of the application, front and rear stabilizers 61 and 62 made of soft plastic act as softeners to the stop or slow down of the pushing motion. Front and rear stabilizers 61 and 62 further act to minimize and soften the pinch point when the ride-on toy 100 tilts forward and back as they are the only parts that touch the floor.

With reference back to FIG. 1, in embodiments of the application, front handle 40 comprises two arms 41, 42 connected at a distal end thereof by bar 43. Similarly, rear handle 50 comprises two arms 51, 52 connected at a distal end thereof by bar 53. and back handle comprises two arms and a first bar connecting the two bars at distal ends thereof. In embodiments of the application, front and rear handles 40, 50 are made from plastic softer than main body 10 and are threaded into, interlocked with or otherwise connected to main body 10. In other embodiments, main body 10, front handle 40, and read handle 50 may be integrally formed.

As illustrated in FIG. 1, in preferred embodiments of the application, rear handle 50 is longer than front handle 40. This allows front handle 40 to be used as a steering/support handle when the ride-on toy 100 is being used as in ride mode as illustrated in FIG. 5A, and rear handle 50 to be used as a steering/support handle when the ride-on toy 100 is being used as in push-walker mode as illustrated in FIG. 5B. It is understood that a longer rear handle 50 may also serve to act as rearward motion limiter for a child using the device in ride mode, preventing accidental rearward dismount.

With reference back to FIG. 1, in embodiments of the application, seat 30 is positioned above wheel 20 and between front handle 40 and rear handle 50. In some embodiments of the application, seat 30 is made of plastic softer than main body 10 and is threaded into, interlocked with, adhered to, or otherwise connected to main body 10. In other embodiments, seat 30 is integrally formed with main body 10 and comprises a contoured surface for a rider to sit.

It is understood that in embodiments of the application, two or more of main body 10, a wheel 20, seat 30, front handle 40, rear handle 50, front stabilizer 61 and rear stabilizer 62 may be integrally formed and threaded into, interlocked with, adhered to, or otherwise connected with remaining portions of the ride-on toy. It is further contemplated that in embodiments of the application, individual elements may be comprised of separate parts that are threaded into, interlocked with, adhered to, or otherwise connected with each other. Plastic parts of the application may be formed by injection-molding or other conventional methods.

Figure 6:
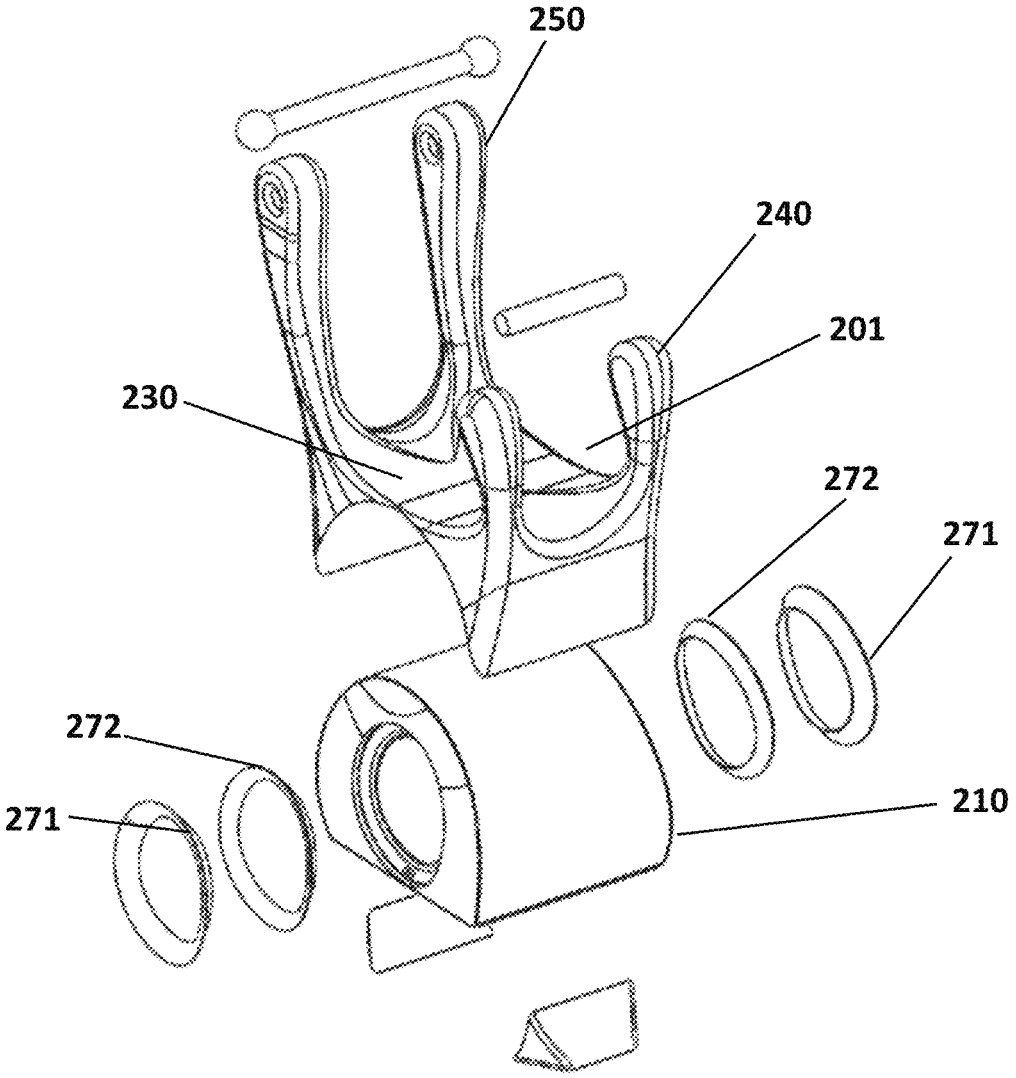
FIG. 6 is an exploded view of a ride-on toy of a second embodiment of the application.

In one preferred embodiment of the application illustrated in FIG. 6, ride-on toy 200 comprises U-shaped structure 201 and a semi-circular main body 210. U-shaped structure 201 comprises integrally formed seat 230, arms of front handle 240, and arms of rear handle 250. As shown in the figure, in some embodiments of the application, light covers 271 made from semi-transparent colored plastic and LED light strips 272 are mounted in the wheel holes.

Figure 7:
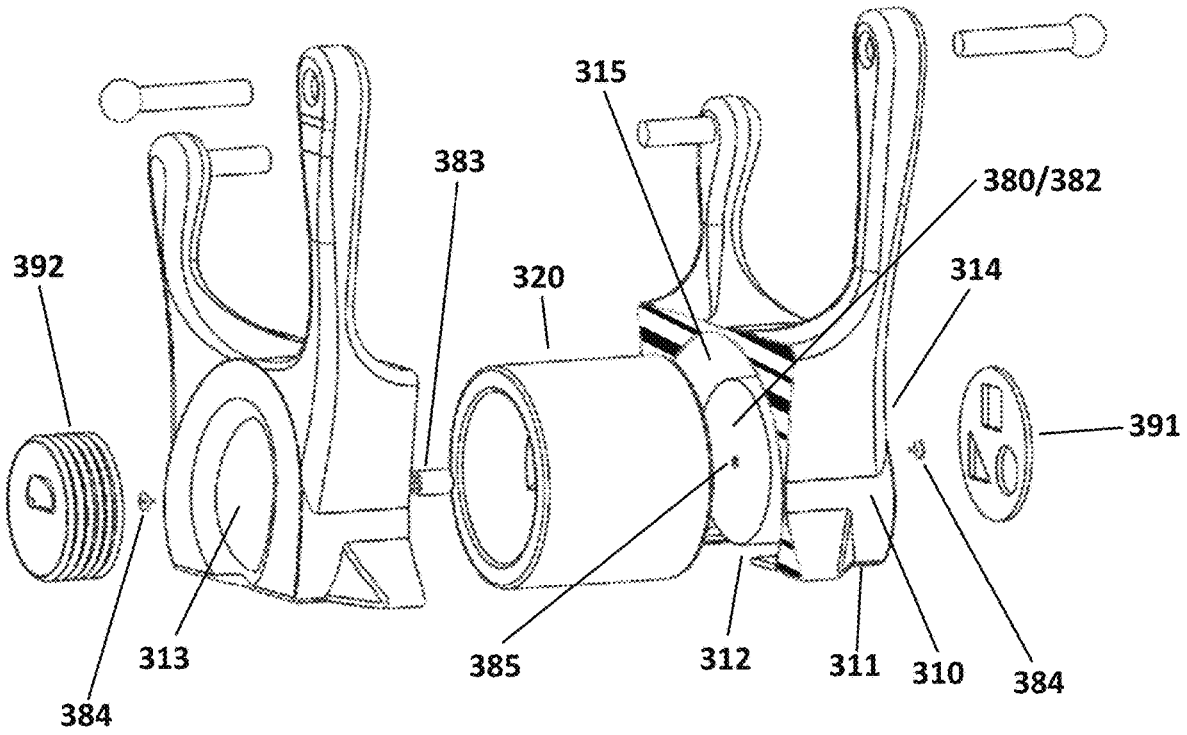
FIGS. 7-8 are exploded sectional views of a ride-on toy of a third embodiment of the application.
Figure 8:
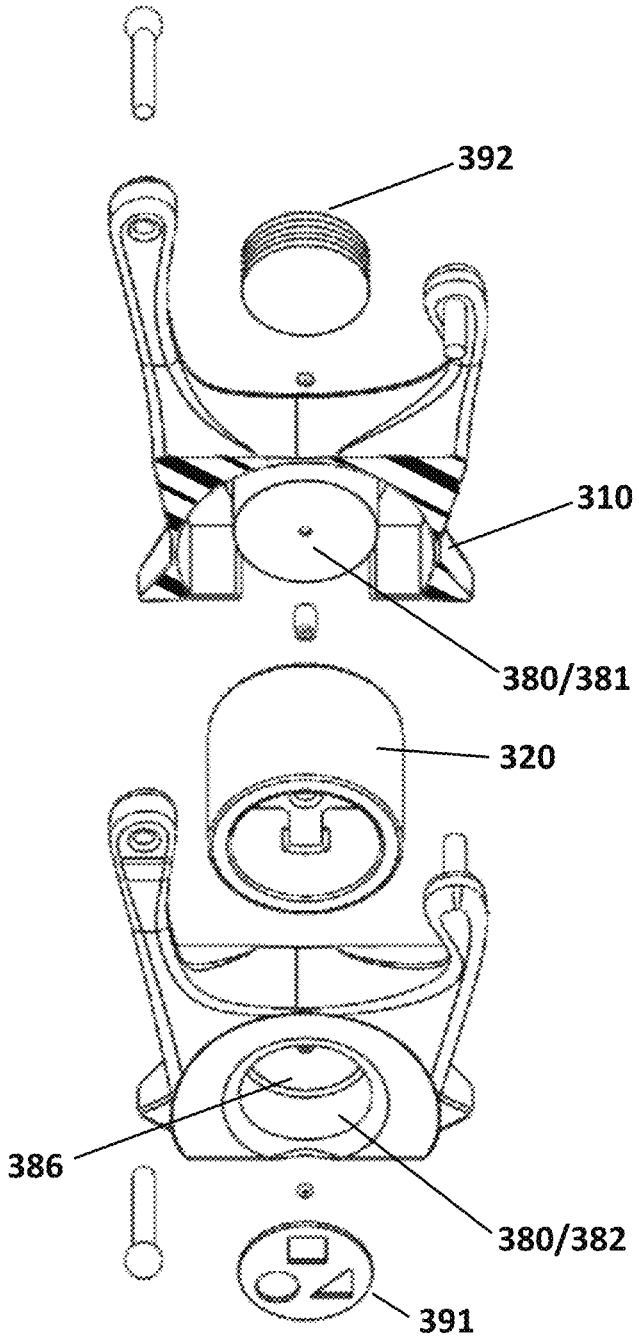
Figure 9:
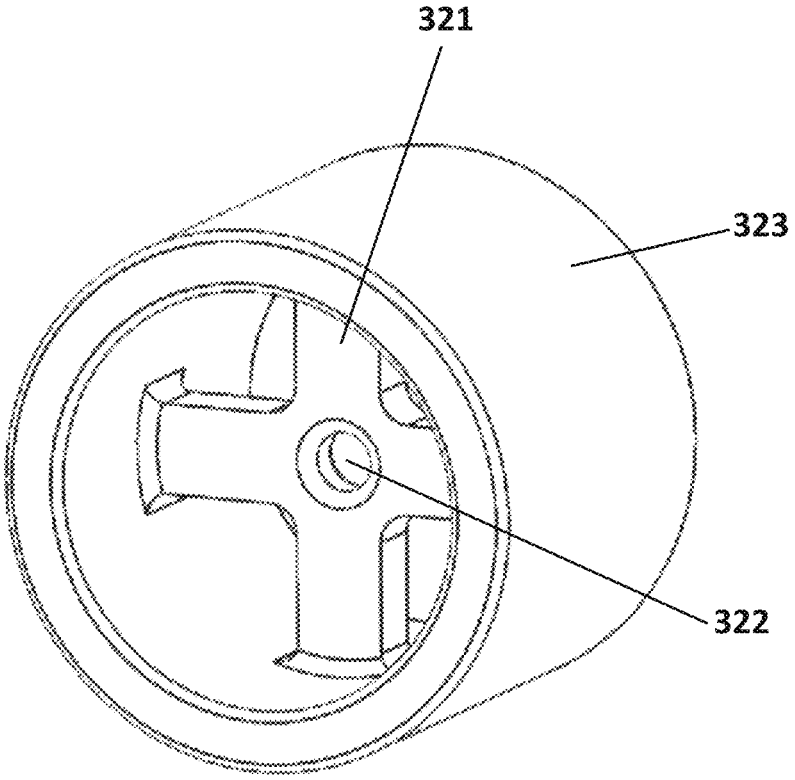
FIG. 9 is a perspective view of a wheel of the third embodiment.

FIGS. 7-9 illustrate an embodiment of the application in which ride-on toy 300 comprises a mechanical wheel 320. It is understood that FIG. 7-8 include sectional views of main body 310 along a plane bisecting ride-on toy 300 in front-to-rear direction. In this embodiment, main body 310 comprises a shell having a lower wall 311 in which a bottom hole 312 is formed. Left and right holes 313 and 314 are formed at either side of main body 310. As shown in FIG. 9, wheel 320 is a hollow cylinder having a mounting structure 321 formed in the middle thereof. In this embodiment, mounting structure 321 comprises four struts meeting at a central portion in which a mounting hole 322 is formed. However, it is understood that the mounting structure 321 may employ any number of struts or may be disk shaped. In the illustrated embodiment, the outer surface 323 of wheel 320 is smooth. In other embodiments, the outer surface of the wheel may have a rough exterior pattern for improved traction.

As illustrated in FIG. 7-8, in embodiments of the application, a wheel support 380 is disposed in cavity 315 formed in the main body 310. In the illustrated embodiment, wheel support 380 includes a left axle support 381, a right axle support 382, and an axle 383. As shown in the figures, left axle support 381 is disposed in left hole 313 and right axle support 382 is disposed in right hole 314. In this embodiment, each of the axle supports 381 and 383 is a hollow cylinder closed at one end with a mounting surface 385 so as to form a cavity 386. When assembled, the wheel 320 is mounted on axle 383 between the two facing mounting surfaces 385 of axle supports 381 and 382. Axle 383 passes through mounting hole 322 and is screwed into holes formed in respective mounting surfaces 385 with screws 384, such that wheel 320 is rotatable around an axis defined by axle 383. However, it is understood that in other embodiments, the left and right axle supports and the axle may be integrally formed. In preferred embodiments, left axle support 381, a right axle support 382, and an axle 383 are made from hard plastic. It is understood that in other embodiments of the application, wheel 320 may be replaced with two or more wheels that rotate around an axis defined by axle 383.

As shown in FIGS. 7 and 8, in embodiments of the application, an accessory toy may be fitted into the left and/or right holes 313, 314 such that they are partially received in respective cavity 386 or communicate with cavity 386. For example, in FIGS. 7-8, a shape sorting toy 391 is provided, wherein the toy comprises multiple holes with different shapes for allowing a child to fit the correct shaped block through the holes and into cavity 386. It is understood that the blocks can be included as part of the of ride-on toy 300 and stored in the cavity, saving space.

As further shown in FIGS. 7 and 8, a push toy 392 may be provided. Push toy 392 is at least partially received in a cavity 386 and is configured to make a honking noise when pressed. It is understood that in other embodiments of the application, other accessory toys may be use in place of shape sorting toy 391 and/or push toy 392. In these embodiments, the interior space provided by cavities 386 is utilized to save space in the home and to add engagement value to the ride-on toy.

Figure 10:
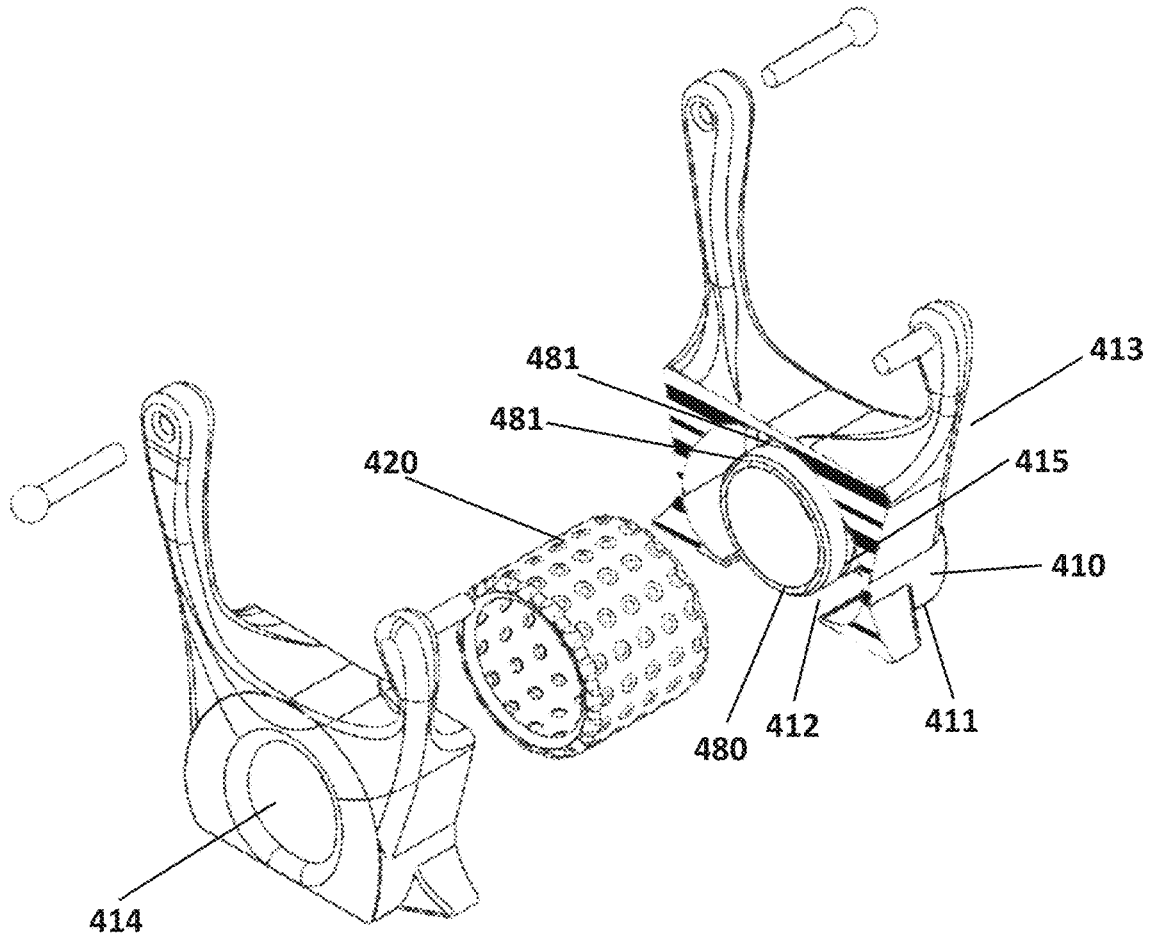
FIGS. 10-11 are exploded sectional views of a ride-on toy of a fourth embodiment of the application.
Figure 11:
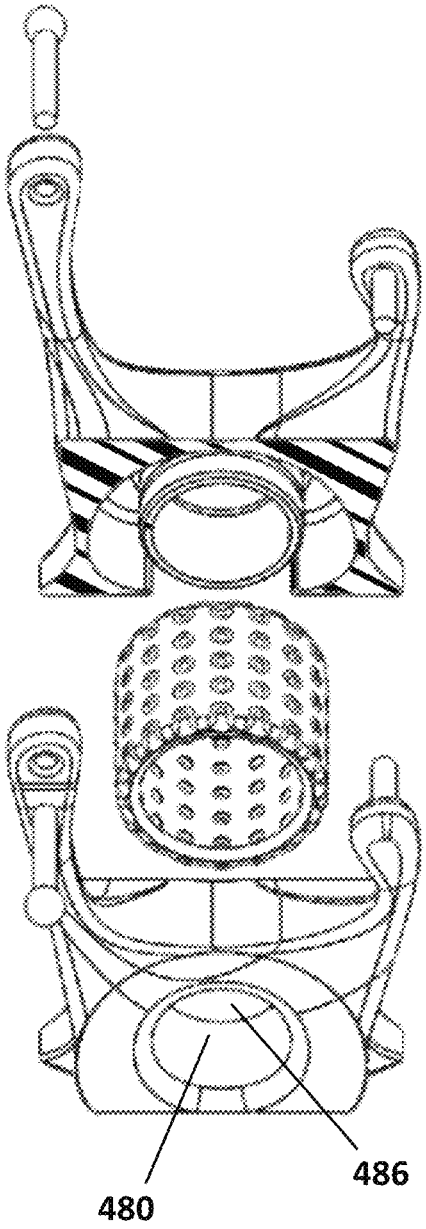
Figure 12:
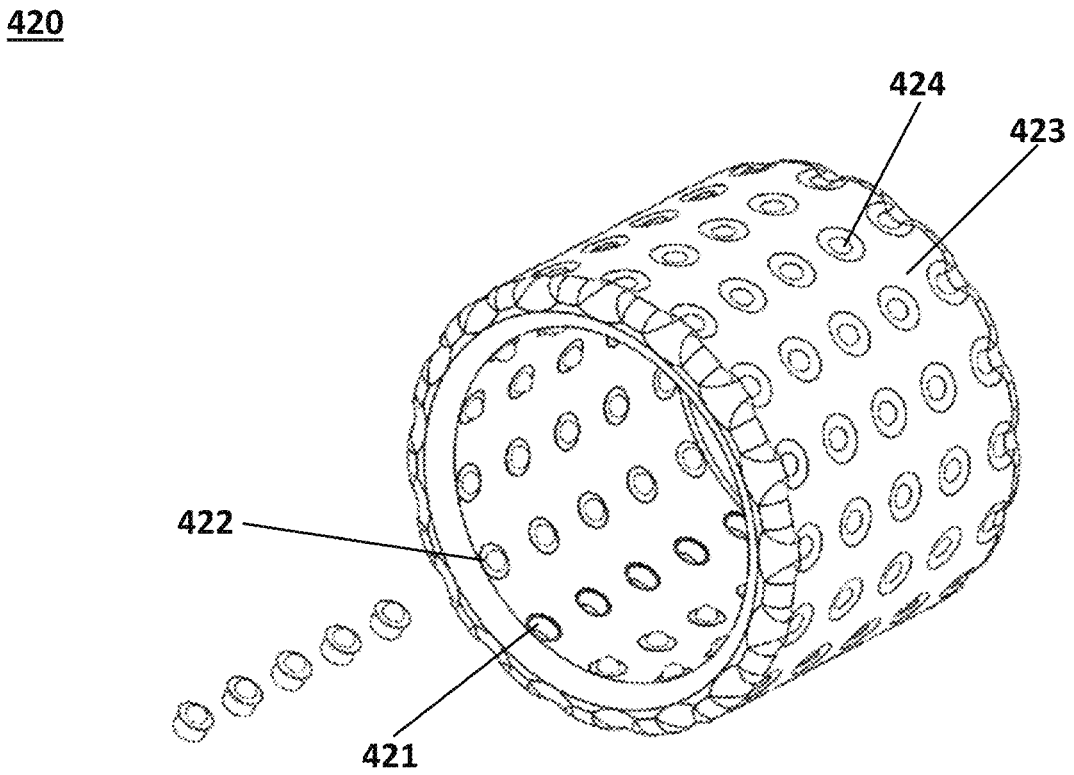
FIG. 12 is a perspective view of a wheel of the fourth embodiment.

FIGS. 10-13 illustrate an embodiment of the application in which ride-on toy 400 comprises a bearing type wheel 420. It is understood that FIGS. 10-11 and 13 include sectional views of main body 410 and wheel support 480 along a plane bisecting ride-on toy 400 in front-to-rear direction. In this embodiment, main body 410 comprises a shell having a lower wall 411 in which a bottom hole 412 is formed. Left and right holes 413 and 414 are formed at either side of main body 410. As shown in FIG. 12, wheel 420 is a hollow cylinder having a plurality of rows of sockets 421 having balls 422 received therein. Sockets 421 are proportioned to hold balls 422 such that a portion protrudes therefrom and to provide balls 422 with a 360 degrees range of movement. In embodiments of the application, balls 422 may be made of nylon, metal, or other suitable materials known in the art. In the illustrated embodiment, the outer surface 423 of wheel 420 is provided with rough exterior patterns 424 for improved traction. In other embodiments, the outer surface of the wheel may be smooth.

Figure 13:
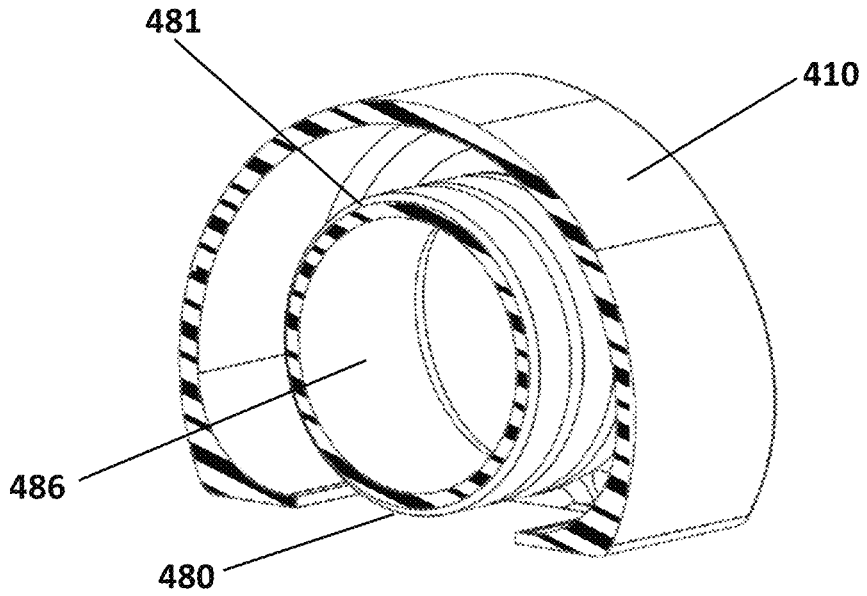
FIG. 13 is a is a close-up sectional view of a wheel support and main body of the fourth embodiment.

As illustrated in FIGS. 10-11 and 13, in embodiments of the application, a wheel support 480 is disposed in a cavity 415 formed in the main body 410. In the illustrated embodiment, wheel support 480 is a hollow cylinder connected between holes 413 and 414 so as to form a cavity 486. An outer surface of wheel support 480 is provided with a plurality of tracks 481 which correspond to the plurality of rows of sockets 421. When assembled such that wheel 420, which in embodiments of the application is also a hollow cylinder, is sleeved onto wheel support 480, the balls 421 are aligned with and run in tracks 481 and act as bearing motion transformers, creating with wheel and wheel support a working bearing with an inner ring static body and an outer ring rotating wheel. It is understood that in embodiments of the application, the positions of the socket/balls and tracks may be reversed such that the socket/balls are located on wheel support 480 and the tracks are located on wheel 420.

It is contemplated that in embodiments of the application, one or more accessory toys (not illustrated) may be disposed left and/or right holes 413, 414 such that they are partially received in cavity 486 or communicate with cavity 486, as described in connection with ride-on toy 300, as described in connection with other embodiments of the application.

Figure 14:
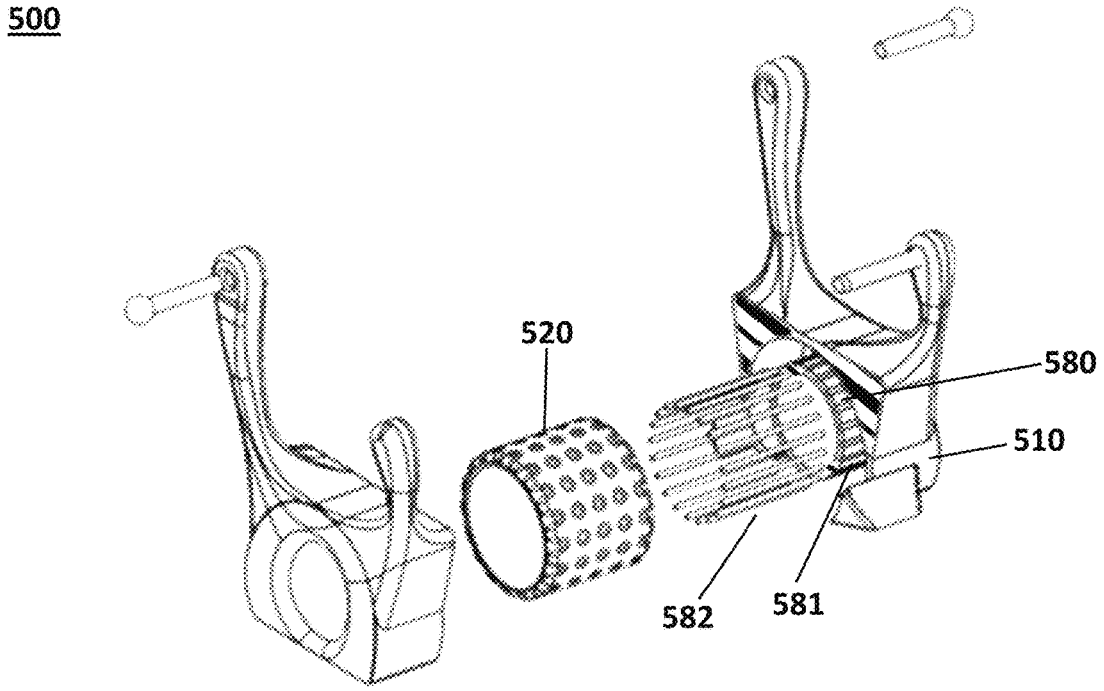
FIG. 14 is an exploded sectional views of a ride-on toy of a fifth embodiment of the application.
Figure 15:
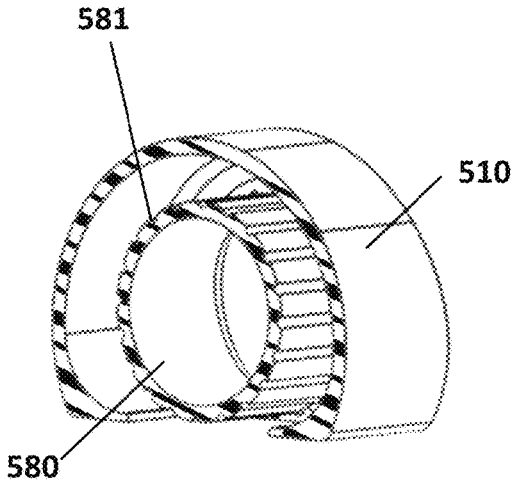
FIG. 15 is a is a close-up sectional view of a wheel support and main body of the fifth embodiment.
Figure 16:
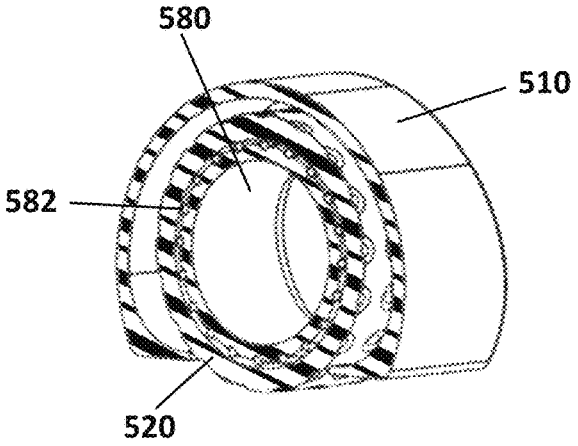
FIG. 16 is a close-up sectional view of a wheel support, wheel and main body of the fifth embodiment.

In an alternate embodiment of a bearing type wheel illustrated in FIGS. 14-16, a ride-on toy 500 includes a wheel support 580 having an outer surface on which a plurality of sockets 581 are formed. It is understood that FIG. 14-16 include sectional views of main body 510 and wheel support 580 along a plane bisecting ride-on toy 500 in front-to-rear direction. Sockets 581 are proportioned to hold cylindrical rollers 582 in a rotatable manner. When assembled such that wheel 520, which in embodiments of the application is also a hollow cylinder, is sleeved onto wheel support 580 as shown in FIG. 16, cylindrical rollers 582 act as bearing motion transformers, creating with wheel and wheel support a working bearing with an inner ring static body and an outer ring rotating wheel such that wheel is rotatable relative to the wheel support. It is understood that in embodiments of the application, the positions of the sockets/rollers may be reversed such that the sockets/rollers are located on wheel 520. In embodiments of the application, rollers 582 may be made of hard plastic, metal, or other suitable materials known in the art.

Figure 17:
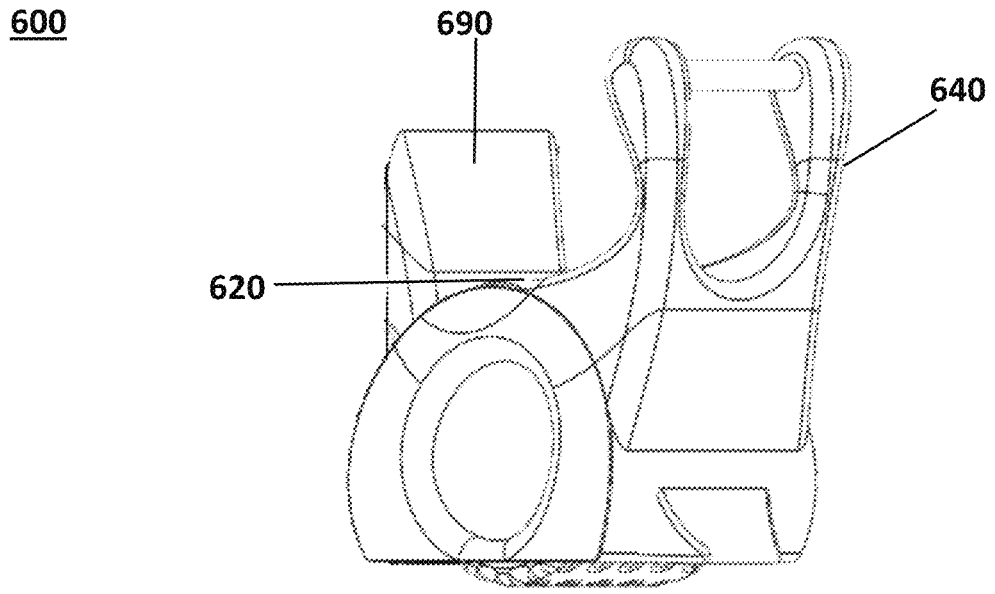
FIG. 17 is a perspective view of a ride-on toy of a seventh embodiment of the application.
Figure 18:
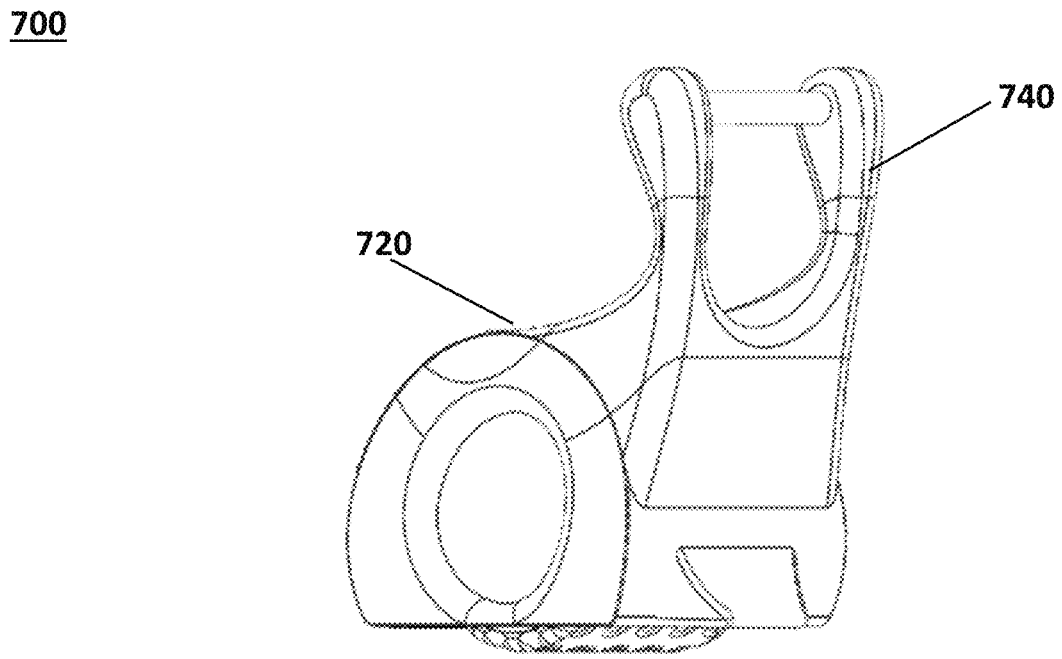
FIG. 18 is a perspective view of a ride-on toy of an eighth embodiment of the application.

FIGS. 17 and 18 illustrate two more embodiments of the application in which there is only one handle. In FIG. 17, a ride-on toy 600 includes a front handle 640 and a backrest 690, with a seat 620 located between front handle 640 and backrest 690. In FIG. 18, a ride-on toy 700 includes a front handle 740 and seat 720 with nothing in the rear.

It is further understood that while the drawings of the application illustrate embodiments in which holes are provided on the left and right side of the main body, in other embodiments of the application, the left and right sides of the main body are continuous surfaces with no openings corresponding to the wheel.

The centered wheel ride-on toys of the application that children can sit on and ride or push provide new opportunities for playing, riding, and learning. As a developmental toy for toddlers, the ride-on feature creates a rocking motion as well as a stabilizing ride that stimulates development of toddlers' gross motor skills, keeping their whole body active and strengthening their minds and coordination. The push-walker feature adds additional developmental opportunities by challenging different motor skills, so children can learn new ways of motion with a stable upper body provided by the front handle and balancing on a centered wheel requiring activity by the lower body and feet. Compared with conventional rider-on toys with two or more wheels, the ride-on today of the present application requires balancing that benefits development significantly. Studies have shown that people with insufficient early development gross motor skills' were diagnosed with ADD and other learning and behavioral disabilities at higher rates.

Moreover, the arrangement of the main body, wheel and stabilizers effectively controls the speed and movement of the toy, improving safety. Moreover, with one or more toys provided in the hollow wheel, children get a one stop, space-efficient station for all their physical and emotional needs, allowing fun and safe play time with a toy that adapts to their needs and pace. The multi-function toys of the application grow with the child, so there is no need to buy a new toy for each stage of development.

It is understood that features of the embodiments described above allow persons having ordinary skill in the art to clearly appreciate the form of the present specification. Persons having ordinary skill in the art can appreciate that the objectives and/or the advantages of the above embodiments can be accomplished in a manner consistent with the above embodiments by designing or modifying other processes and structures based on the content of the present disclosure. Persons having ordinary skill in the art can also appreciate that the equivalent constructions without departing from the scope and spirit of the present invention can be modified, substituted or retouched without departing from the scope and spirit of the present invention.

What is claimed is:

1. A ride-on toy, comprising:

a main body comprising a lower wall, the lower wall having a first opening;

a centered wheel rotatably mounted in the main body, wherein a portion of the wheel protrudes from the main body through the first opening;

a seat connected to the main body;

a first handle extending away from the main body;

a first stabilizer connected to the lower wall at a first side of the first opening, arranged such that when the ride-on toy is disposed on a flat surface in a first position, the surface and the first stabilizer are separated by a first distance, and when the ride-on toy is disposed on the surface in a second position, the first stabilizer contacts the surface; and a second stabilizer connected to the lower wall at a second side of the first opening opposite to the first side, arranged such that when the ride-on toy is disposed on the flat surface in the first position, the surface and the second stabilizer are separated by the first distance, and when the ride-on toy is disposed on the surface in the second position, the second stabilizer is separated from the surface by a second distance greater than the first distance, and when the ride-on toy is disposed on the surface in a third position, the second stabilizer contacts the surface, and the first stabilizer is separated from the surface by a third distance greater than the first distance;

arranged such that when the ride-on toy is disposed on the flat surface, it can be rocked back and forth relative to an axis of rotation defined by the centered wheel between the first position and the third position with the first and second stabilizers remaining below the axis of rotation.

2. A ride-on toy, comprising:

a main body comprising a lower wall, the lower wall having a first opening;

a centered wheel rotatably mounted in the main body, wherein a portion of the wheel protrudes from the main body through the first opening;

a seat connected to the main body;

a first handle extending away from the main body;

arranged such that when the ride-on toy is disposed on a flat surface, it can be rocked back and forth relative to an axis defined by the centered wheel;

a first stabilizer connected to the lower wall at a first side of the first opening, arranged such that when the ride-on toy is disposed on a flat surface in a first position, the surface and the first stabilizer are separated by a first distance, and when the ride-on toy is disposed on the surface in a second position, the first stabilizer contacts the surface a second stabilizer connected to the lower wall at a second side of the first opening opposite to the first side, arranged such that when the ride-on toy is disposed on the surface in the first position, the surface and the second stabilizer are separated by the first distance, and when the ride-on toy is disposed on the surface in the second position, the second stabilizer is separated from the surface by a second distance greater than the first distance, and when the ride-on toy is disposed on the surface in a third position, the second stabilizer contacts the surface, and the first stabilizer is separated from the surface by a third distance greater than the first distance;

wherein the main body, the first stabilizer, and the second stabilizer are made of plastic, and the plastic of the first and second stabilizers is softer than that of the main body.

3. The ride-on toy of claim 1, wherein the first handle comprises two arms and a first bar connecting the two arms at distal ends thereof.

4. The ride-on toy of claim 1, further comprising a second handle, wherein the seat is disposed between the first and second handles, and the second handle is longer than the first handle.

5. The ride-on toy of claim 4, wherein the second handle comprises two arms and a second bar connecting the two arms at distal ends thereof.

6. The ride-on toy of claim 1, wherein the main body comprises a cavity, further comprising a wheel support disposed in the cavity, and wherein the wheel is rotatably disposed on the wheel support.

7. The ride-on toy of claim 6, wherein the wheel comprises a hollow first cylinder, the wheel support comprises a second cylinder, and the second cylinder is sleeved by the first cylinder.

8. A ride-on toy, comprising:

a main body comprising a lower wall, the lower wall having a first opening;

a centered wheel rotatably mounted in the main body, wherein a portion of the wheel protrudes from the main body through the first opening;

a seat connected to the main body; and a first handle extending away from the main body;

arranged such that when the ride-on toy is disposed on a flat surface, it can be rocked back and forth relative to an axis defined by the centered wheel;

wherein the main body comprises a cavity, further comprising a wheel support disposed in the cavity, and wherein the wheel is rotatably disposed on the wheel support;

wherein the wheel comprises a hollow first cylinder, the wheel support comprises a second cylinder, and the second cylinder is sleeved by the first cylinder; and wherein one of the first cylinder and the second cylinder comprises a plurality of rows of sockets, and the other of the first cylinder and the second cylinder comprises a plurality of inner tracks corresponding to the plurality of rows, and wherein a plurality of balls are received in the sockets and rotatable such that the wheel is rotatable relative to the wheel support.

9. The ride-on toy of claim 7, wherein one of the first cylinder and the second cylinder comprises a plurality of sockets, and wherein a plurality of cylindrical rollers are received in the sockets and rotatable such that that the wheel is rotatable relative to the wheel support.

10. The ride-on toy of claim 7, wherein the second cylinder is hollow and the main body comprises a second opening corresponding to a first side of the wheel, further comprising a first accessory toy disposed in the second opening, and wherein the first toy accessory comprises openings communicating with and/or is partially received in an interior space of the second cylinder.

11. The ride-on toy of claim 6, wherein the wheel support comprises a first axle support, a second axle support, and an axle connecting the first and second axle supports, and wherein the wheel is rotatably disposed on the axle.

12. The ride-on toy of claim 11, wherein the first axle support is hollow and the main body comprises a second opening corresponding respectively a first side of the wheel, further comprising a first accessory toy disposed in the second opening, the first accessory toy communicating with and/or partially received in an interior space of the first or second axle supports.

13. The ride-on toy of claim 12, wherein the second axle support is hollow and the main body comprises a third opening corresponding respectively to a second side of the wheel opposite to the first side of the wheel, further comprising a second accessory toy disposed in the third opening, the second accessory toy communicating with and/or partially received in the interior space of the first or second axle supports.

14. A ride-on toy, comprising:

a main body comprising a lower wall, the lower wall having a first opening;

a centered wheel rotatably mounted in the main body, wherein a portion of the wheel protrudes from the main body through the first opening;

a first handle;

a second handle, wherein the second handle is longer than first handle;

a seat connected to the main body between the first and second handles;

a first stabilizer connected to the lower wall at a first side of the first opening; and a second stabilizer connected to the lower wall at a second side of the first opening opposite to the first side;

arranged such that when the ride-on toy is disposed on a flat surface, it can be rocked back and forth relative to an axis of rotation defined by the centered wheel between a first position in which the first stabilizer contacts the flat surface and the second stabilizer is separated from the flat surface, and a second position in which the second stabilizer contacts the flat surface and the first stabilizer is separated from the flat surface, with the first and second stabilizers remaining below the axis of rotation.

15. The ride-on toy of claim 14, wherein the main body comprises a cavity, further comprising a wheel support disposed in the cavity, and wherein the wheel is rotatably disposed on the wheel support.

16. The ride-on toy of claim 15, wherein the wheel comprises a hollow first cylinder, the wheel support comprises a second cylinder, the second cylinder is sleeved by the first cylinder, and the wheel is rotatable relative to wheel support.

17. The ride-on toy of claim 15, wherein the wheel support comprises a first axle support, a second axle support, and an axle connecting the first and second axle supports, and wherein the wheel is rotatably disposed on the axle.

18. A ride-on toy, comprising:

a main body comprising a first sidewall and a second sidewall, the first sidewall having a first opening, and the second sidewall having a second opening;

a centered wheel rotatably mounted in the main body arranged such that when the ride-on toy is disposed on a flat surface, it can be rocked back and forth relative to an axis defined by the centered wheel;

a first handle;

a second handle, wherein the second handle is longer than first handle;

a seat connected to the main body between the first and second handles;

a first accessory toy disposed in the first opening; and a second accessory toy disposed in the second opening;

wherein the first and second accessory toys communicate with and/or are at least partially received in an interior space define by the wheel.

* * * * *